US006540886B1

(12) United States Patent
Russell

(10) Patent No.: US 6,540,886 B1
(45) Date of Patent: Apr. 1, 2003

(54) CATHODIC PROTECTION SYSTEM UTILIZING A MEMBRANE

(76) Inventor: Gordon I. Russell, 442 Indian Road, Burlington, Ontario (CA), L7T 3T3

( * ) Notice: Subject to any disclaimer, the term of this patent is extended or adjusted under 35 U.S.C. 154(b) by 0 days.

(21) Appl. No.: 09/715,518

(22) Filed: Nov. 17, 2000

(51) Int. Cl.[7] ..... C23F 13/00

(52) U.S. Cl. ..... 204/196.01; 204/196.06; 204/196.07; 204/196.37

(58) Field of Search ..... 204/252, 196.01, 204/196.06, 196.07, 196.37

(56) References Cited

U.S. PATENT DOCUMENTS

| | | | |
|---|---|---|---|
| 2,329,961 A | 9/1943 | Walker | |
| 2,941,935 A | 6/1960 | Miller et al. | |
| 3,272,731 A | 9/1966 | Hutchison et al. | |
| 3,461,051 A | 8/1969 | Vrable | |
| 3,595,774 A | 7/1971 | Bremerman | |
| 3,729,773 A | 5/1973 | Dillon | |
| 3,831,389 A | 8/1974 | Lipona | |
| 4,654,217 A | 3/1987 | Nagoshi | |
| 4,689,963 A | 9/1987 | Sakai | |
| 4,755,267 A | 7/1988 | Saunders | |
| 4,968,520 A | 11/1990 | Wang | |
| 5,165,256 A | 11/1992 | Yamada | |
| 5,168,712 A | 12/1992 | Coelho et al. | |
| 5,295,368 A | 3/1994 | Franklin | |
| 5,538,535 A | 7/1996 | Pinnau et al. | |
| 6,004,607 A | 12/1999 | Brackebusch et al. | |
| 6,238,530 B1 * | 5/2001 | Yoshida et al. | 204/252 |

OTHER PUBLICATIONS

Pourbaix, "Glossary," *Atlas of Electrochemical Equilibria in Aqueous Solutions,* Second English Ed. 1974, p. 16, NACE International, NACE Cebelcor, Houston No month available.

Pourbaix, et al., "Chapter IV: Establishment and Interpretation of Potential–pH Equilibrium Diagrams," *Atlas of Electrochemical Equilibria in Aqueous Solutions,* Second English Ed. 1974, pp. 307–342, NACE International, NACE Cebelcor, Houston No month available.

(List continued on next page.)

*Primary Examiner*—Bruce F. Bell
(74) *Attorney, Agent, or Firm*—Christie, Parker & Hale, LLP

(57) ABSTRACT

A cathodic protection system for corrosion protection of metallic structures in contact with aqueous solutions such as salt water and calcium chloride brine. The system employs anode chambers containing hydroxide anolytes segregated from the electrolyte containing chloride by an ion-exchange membrane. The anode and the structures to be protected are coupled to voltage and current sources impressing current at the immersed surfaces of metallic structures to maintain these surfaces close to an equipotential and covered with a bound layer of polarized hydroxide. The preferred embodiment is used in connection with stainless steel holding tanks and associated equipment used to circulate calcium chloride brine to freeze whole muscle turkeys. When the brine and the anolyte contact the membrane, a bi-ionic potential forms across the membrane that drives the counter-directed transport of ions through the membrane, thereby preventing the anodic production of $Cl_2$. Additionally, pH control is employed and a controller is coupled to one or more of a series of reference electrodes used to monitor the potential differences between the electrodes and the metal surfaces to be cathodically protected. If the potential difference falls outside of a predetermined range, due to changing exposure conditions and/or operating parameters, the applied voltage is adjusted so that the current from the anode produces a polarized and alkaline protective film at the metallic surfaces of the holding tank and associated equipment so as to counteract and overcome the corrosive properties of the brine.

31 Claims, 3 Drawing Sheets

OTHER PUBLICATIONS

Uhlig, et al., "Chapter 4: Polarization and Corrosion Rates," *Corrosion and Corrosion Control, An Introduction to Corrosion Control and Engineering,* Third Ed. 1985, pp. 58–59, John Wiley & Sons, Inc., New York No month available.

Uhlig, et al., "Chapter 12: Cathodic Protection / Anodic Protection," *Corrosion and Corrosion Control, An Introduction to Corrosion Control and Engineering,* Third Ed. 1985, pp. 217–221, John Wiley & Sons, Inc., New York No month available.

Uhlig, et al., "Chapter 17: Treatment of Water and Steam Systems," *Corrosion and Corrosion Control, An Introduction to Corrosion Control and Engineering,* Third Ed. 1985, pp. 282–283, 292, John Wiley & Sons, Inc., New York No month available.

Uhlig, "Iron and Steel," *The Corrosion Handbook,* 1948, pp. 128–131, ISBN 0 471 89562 8, John Wiley & Sons, Inc., USA No month available.

Uhlig, "Chromium–Nickel Austenitic Stainless Steels," *The Corrosion Handbook,* 1948, pp. 164–169, ISBN 0 471 89562 8, John Wiley & Sons, Inc., USA No month available.

Uhlig, "Fundamentals of Cathodic Protection," *The Corrosion Handbook,* 1948, pp. 924–933, ISBN 0 471 89562 8, John Wiley & Sons, Inc., USA No month available.

Uhlig, "Application of Cathodic Protection," *The Corrosion Handbook,* 1948, p. 949, ISBN 0 471 89562 8, John Wiley & Sons, Inc., USA No month available.

Morgan, *Cathodic Protection,* Second Ed. 1987, pp. 4–11, ISBN 0–915567–28–8, National Association of Corrosion Engineers, Houston No month available.

* cited by examiner

FIG. 1
PRIOR ART
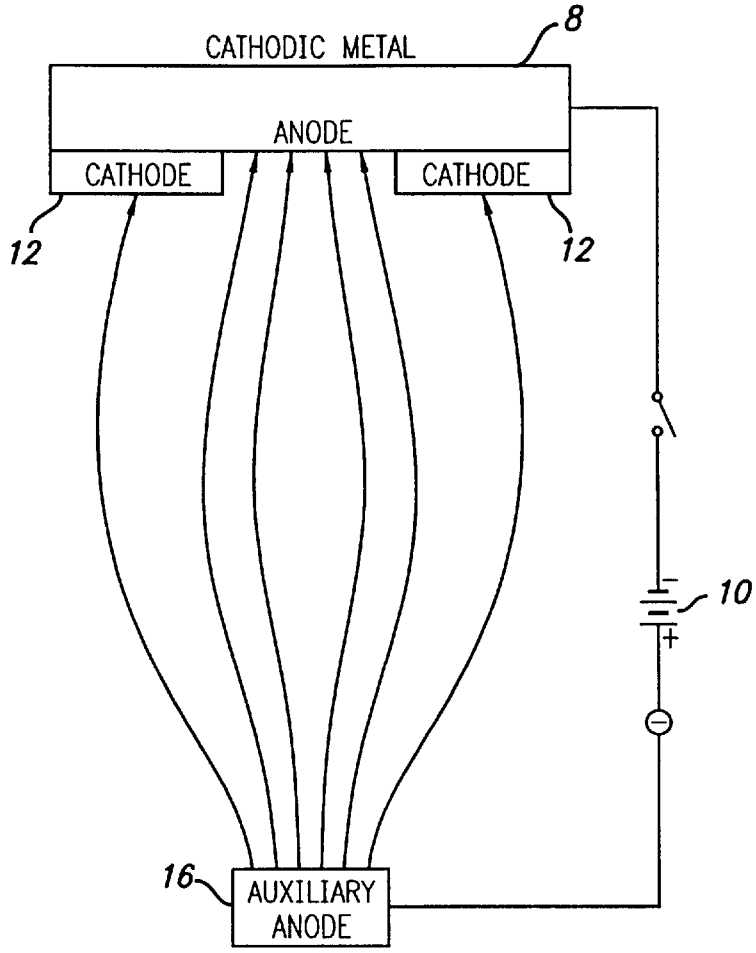
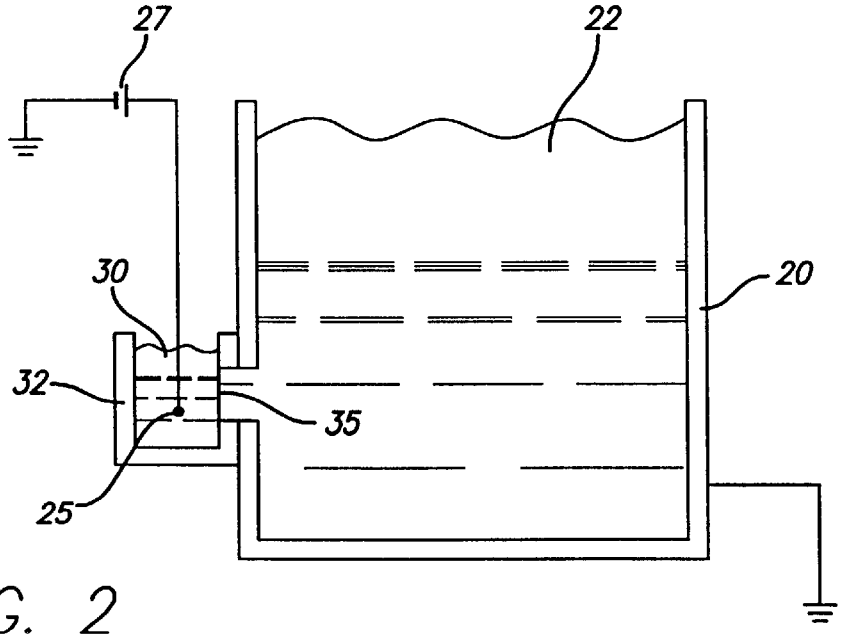
FIG. 2

CATHODIC PROTECTION SYSTEM UTILIZING A MEMBRANE

BACKGROUND OF THE INVENTION (i) Field of the Invention

The invention relates to systems for providing cathodic protection to metals and alloys subject to corrosion when in contact with electrically conductive and corrosive liquids. A preferred embodiment of the invention resides in a system for protecting from corrosion large metal holding tanks containing a super-cooled aqueous solution of calcium chloride brine used for rapidly cooling and/or freezing of poultry.

(ii) Description of the Related Art

Many metals and alloys, particularly those comprising a significant iron content, are known to corrode or rust when exposed to salt water or other environment electrolytes capable of conducting and transferring an electric current, and thereby transporting ions from the metal. To retard corrosion of such metals, it is known to apply anodic protection or to apply coatings, and/or to apply cathodic protection. Cathodic protection is particularly used with pipes, pumps, heat exchangers, holding tanks, and other containments of aqueous solutions where corrosion would occur in the absence of cathodic protection.

FIG. 1 is a schematic diagram depicting a well-known prior art system with impressed current providing cathodic protection to a corroding metal 8 immersed in an aqueous solution. If cathodic protection were not provided, surfaces of the metal would act as local cathodes 12, while other surfaces would act as local anodes 14. In such an arrangement, potential differences would arise between the anodic and cathodic surfaces due to their exposure to different solutions and/or metal chemistries transferring current in the conductive solution.

Cathodic protection of the corroding metal 8 can be accomplished by coupling the negative terminal of a voltage and current source 10 to the metal with a corroding metallic surface. An auxiliary anode 16 electrically coupled to the positive voltage terminal of the voltage and current source impresses electrical current from the auxiliary anode to both the cathodic and anodic surfaces of the corroding metal before returning to its source. The current is impressed until the entire surface of the corroding metal polarizes toward almost the same potential, thereby preventing electrical current from transferring between different surface exposures on the metal. Accordingly, the metal should not corrode so long as the external current is maintained, because the positively charged cations travel in one direction through the aqueous solution toward the cathode or the metal surface being protected, whereas negatively charged anions, including corrosive ions travel toward the anode.

Cathodic protection can also be employed to counteract and stifle microbiologically influenced corrosion (MIC). Strict (or obligate) anaerobes, in particular sulfate reducing bacteria (SRB), such as Desulfovibrio desuluricans, accumulate and function in the absence of oxygen under deposits and produce $H_2S$, which produces an unpleasant odor, and in combination with iron, forms iron sulphide. In addition, carbon dioxide and hydrogen (produced by cathodic protection) are consumed by methane-producing bacteria methanogens which often coexist in a symbiotic relationship with SRB; thus, these bacteria are capable of promoting cathodic depolarization.

Many aerobic bacteria form sticky slime of extracellular polymers on stainless steels and other metallic surfaces which are ideal sites being devoid of oxygen for SRB. Aerobic bacteria, such as thiobacillus strains produce acids which oxidize sulphide and sulfur forming sulfuric acid as a metabolic by-product under anaerobic deposits where they are usually accompanied by SRB. Also, where iron, manganese, and chlorides are present with iron oxidizers or aerobes, such as Gallionella bacterium, ferric-manganese chloride is produced thereby promoting potent pitting into stainless steels. Moreover, as precipitation of deposits may either be induced or be inhibited through the use of pH control in conjunction with cathodic protection and through bacteria such as SRB (which may still thrive in highly alkaline solutions), deposits should be avoided so that the targeted pH value of the protective film at a steel interface should remain above 10.

Cathodic protection has been used in connection with stainless steel containers holding super-cooled liquid used to rapidly freeze food products such as fowl. Such chillers or freezers typically include an impressed current and voltage source with anodes immersed in the metallic holding tank containing an aqueous liquid solution cooled toward or below the freezing point of water. While such cathodic protection systems have been shown to reduce or prevent corrosion in metallic piping, pumps, and/or of holding tanks (which would otherwise periodically need to be replaced, thereby halting the freezing process), impressed current protection systems often produce undesirable side effects such as the evolution or emission of oxygen and/or chlorine; chlorine production is an environmental safety hazard and also results in the production of corrosive hydrochloric acid. In addition, these systems often need to be recalibrated due to shifting potentials at the surfaces to be protected. Moreover, where seawater is used for cooling, magnesium chloride (a natural constituent of seawater) hydrolyzes into hydrochloric acid, which may corrode components of the pumps, tanks, piping, and heat exchanger cooling equipment.

It would be desirable, therefore, to provide a cathodic protection system that is selfcalibrating and that ensures sufficient protective current is applied to produce a highly alkaline protective film to preserve a metallic structure in a state of immunity without the potentially unsafe and undesirable side effects that have been present in known systems. The present invention satisfies this and other needs and provides further related benefits and advantages.

It would be particularly desirable to provide a cathodic protection system to preserve metallic structures for use with the rapid chilling and/or freezing of food products such as poultry including whole muscle turkeys.

SUMMARY OF THE INVENTION

The current invention is embodied in a system for the cathodic protection of a wetted and/or immersed surface of a metal structure containing or in contact with an electrolyte comprising a voltage and current source impressing current from an electrically coupled anode. A non-metallic chamber contains an electrically coupled anode immersed in an anolyte. A cation exchange membrane impermeable to Cl ions serve as a barrier to separate the anolyte from contacting the electrolyte, but allows protective current transfer by migration of cations from the anolyte along with water into the electrolyte and at the cathode. This separation permits cathodic protection of the metallic surface without any of the adverse side effects accompanying conventional cathodic protection systems in this application.

In one embodiment, the current invention is used to cathodically protect the internal surface of stainless steel pumps, piping, heat exchangers, and holding tanks used in connection with the provision of a low temperature bath to freeze whole muscle turkeys. Turkeys packaged for retail sale are chilled or frozen within a calcium chloride brine bath cooled by a heat exchanger immersed within the holding tanks. The brine is slowly circulated through the holding tanks by the action of pumps causing the floating turkeys to rapidly cool and/or freeze until they reach a far end of the holding tank where they are removed by a conveyor. This process may be repeated, if necessary. Along each holding tank are a series of anode chambers, each having an anode, an anolyte, and a cation exchange membrane acting as an interface separating the anolyte from the brine, thereby preventing the anodic production of $Cl_2$; the impressed current source couples the anode and the stainless steel structures being cathodically protected.

Some embodiments also include auto-potential controllers coupled to reference electrodes to monitor potential differences between the electrodes and the metallic surfaces being cathodically protected. If the potential difference and/or exposure conditions fall outside of a predetermined range, the voltage level to the anodes impressing current is accordingly adjusted to counteract and overcome the corrosive properties of the brine by producing protective film over the cathodic surfaces.

The current invention is also embodied in a system for rapidly chilling fowl products comprising a holding tank having a first end and a second end containing a chilled aqueous bath circulating from the first end of the holding tank to the second end of the holding tank. Means of conveyance for the fowl products into and out of the bath are provided along with a safely separated means of applying protective current for the cathodic protection process to prevent the holding tanks and associated equipment from corroding.

Though the cathodic protection system herein disclosed is used in conjunction with the rapid cooling or freezing of food products, it will be understood that such a system can be applied to any corrosive electrolytic environments involving metals compatible with cathodic protection and associated processes such as underground piping, on-grade tank bottoms, desalination equipment, cooling water tanks and piping, heat exchangers, pumps, feed bins and corn bins, and equipment for beverage production.

BRIEF DESCRIPTION OF THE DRAWINGS

FIG. 1 is a schematic diagram depicting a prior art cathodic protection system utilizing impressed current;

FIG. 2 is a schematic diagram depicting such a cathodic protection system that incorporates the invention;

DESCRIPTION OF THE PREFERRED EMBODIMENTS

Figure 3:
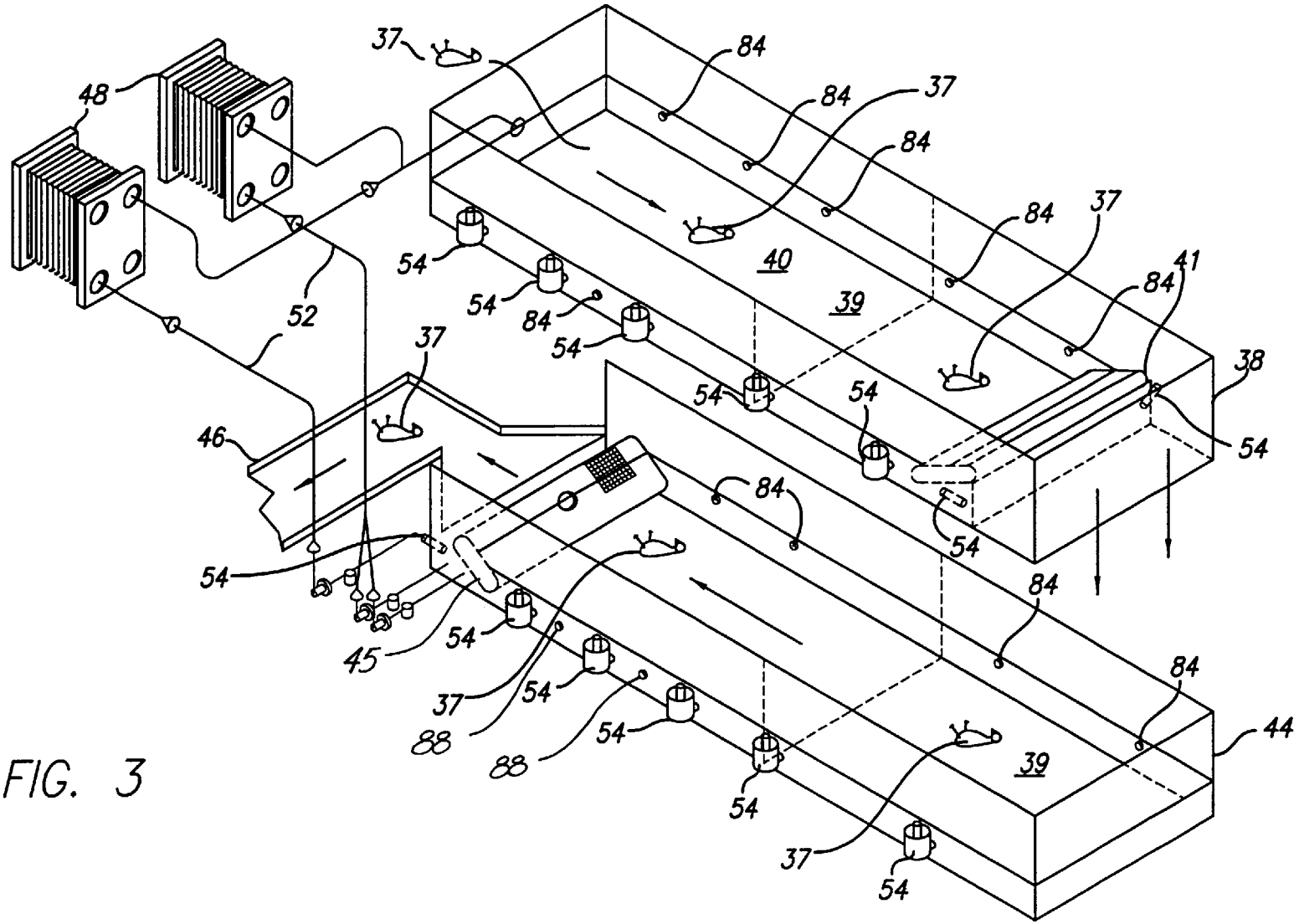
FIG. 3 is a semi-schematic perspective view illustrating the cathodic protection system of the invention as applied in a super-cooled liquid in a holding tank for whole body turkeys.

The present invention will be described by way of example with reference to systems used to prevent corrosion in equipment used for rapidly cooling or freezing food products, in this case, whole muscle turkeys. It is often necessary to freeze such turkeys for transport and later sale. Air-cooling large numbers of turkeys can be time-consuming and expensive. Systems of the type described below provide for much more rapid and economical freezing.

FIG. 2 is a schematic diagram depicting such a system incorporating the invention. The system is built around a metal holding tank 20, which contains a quantity of a chilled or very cold aqueous solution 22. In the absence of the invention, the metal holding tank would be subject to corrosion whenever adverse operating conditions cause ions from the metal surface to enter the electrically conductive solution.

An anode 25 is electrically coupled to the positive voltage terminal of a voltage and current source 27. In this application, both the holding tank 20 and the negative terminal of the voltage and current source are grounded, and the anode immersed in the solution 22 is held at an electrical potential above that of the solution and the immersed surface of the holding tank.

The anode 25 is immersed in an electrically conductive aqueous anolyte 30, which is contained in an anode chamber 32, fixed to one side of the holding tank 20. An ion exchange membrane 35 separates the liquid anolyte from the solution 22. Further details are provided below concerning the holding tank and operation of a preferred cathodic protection system incorporating the invention.

FIG. 3 is a semi-schematic depiction of one embodiment for a system for freezing whole muscle turkeys 37 in a super-cooled liquid bath. After the whole muscle turkeys 37 are appropriately packaged for retail sale, they are deposited into one end of a first stainless steel holding tank 38 (this may be accomplished by a conveyor). The holding tank is filled with super-cooled brine 39 at a temperature preferably in the range of −25° F. to −35° F. The brine flows in a direction 40 away from the end at which the turkeys enter the bath. The turkeys are carried by the brine to the opposite end of the holding tank, where they are lifted out of the brine by a stainless steel conveyor 41.

In the embodiment depicted in FIG. 3, a substantially identical second holding tank 44 is employed such that the turkeys 37 travel through both holding tanks (each 220 feet long) and are exposed to the brine 39 for several hours until they are mostly or completely frozen. After the turkeys exit the second holding tank via a second conveyor 45, they slide down a stainless steel chute 46 where they are later rinsed moved to a freezer (not shown) where they are air-cooled until they are completely frozen. After this process is complete, the turkeys may be maintained in this frozen state for over two years without any degradation in quality.

The brine 39 comprises de-aerated water (accomplished by boiling the water or by nitrogen purging) and approximately 30% by weight calcium chloride. The brine is constantly maintained at a pH value of about 9.0 by the addition or automatic injection of sodium hydroxide (typically several gallons) for pH control to prevent calcareous deposits from forming, to prevent increasing friction at brine/steel interfaces (i.e., of tanks, piping, couplings, pumps, heat exchangers), to maintain thermal transfer efficiency of heat exchangers, and/or to overcome microbiologically influenced corrosion (MIC). In some embodiments, pH control is accomplished by a 1:3 to 1:5 mixture of approximately 30% by weight potassium hydroxide (KOH) and approximately 20% by weight sodium hydroxide (NaOH). Whereas the addition of sodium hydroxide alone has a freezing/gelling temperature of about −20°

F., the addition of a small amount of a 30% aqueous potassium hydroxide lowers the freezing/gelling point of the NaOH/KOH mixture to about −50° F.

Maintaining a pH value in the brine 39 greater than 9.0 with the above NaOH/KOH mixture is also beneficial when protective current is applied, because alternate layers of these hydroxides tend to form in the polarized or bound protective film on the cathodic surface of the metal holding tanks 38, 44 and within associated equipment. Such an arrangement shifts the potential of the polarized protective film over the surface of the holding tank and the associated equipment into the immunity domain at the protected surfaces of wetted and immersed metal, which for iron or the iron content in austenitic stainless steel requires a pH value of about 11.0–11.5.

The brine 39 is circulated through the first and second holding tanks 38, 44 by pumps (not shown), which circulate the brine through at least one heat exchanger 48, in which the brine is cooled, and through piping 52 to ensure that the turkeys 37 are constantly exposed to a supercooled brine maintaining their flow through the tanks. This arrangement permits the cooling and/or freezing of over 100,000 turkeys in a twenty-four hour period.

Figure 4:
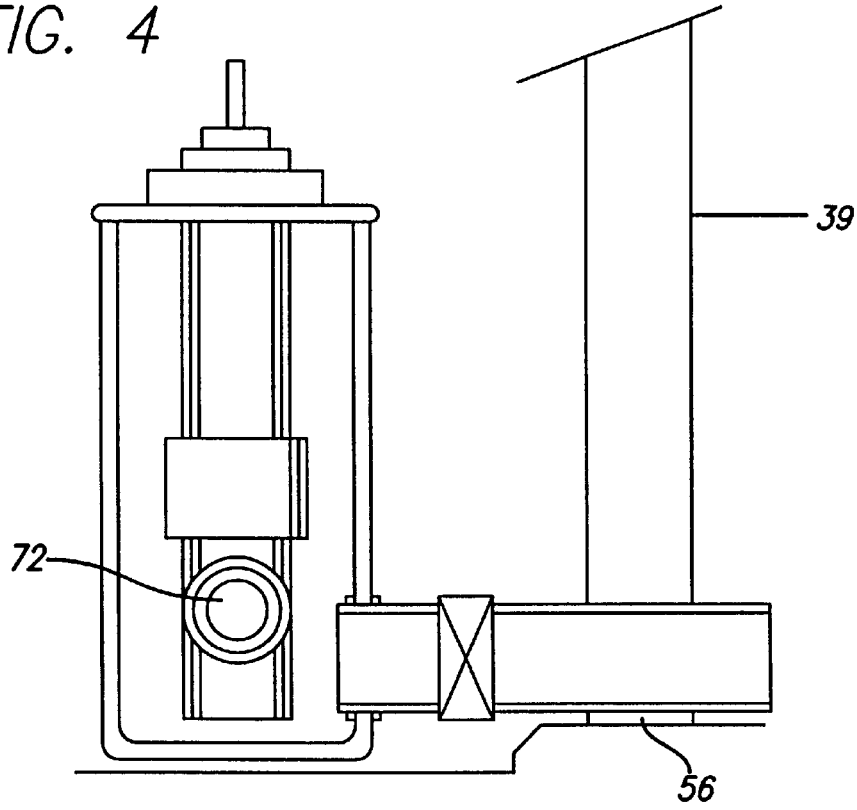
FIG. 4 is a side view of an anode chamber to be used in the system shown of FIG. 3.
Figure 5:
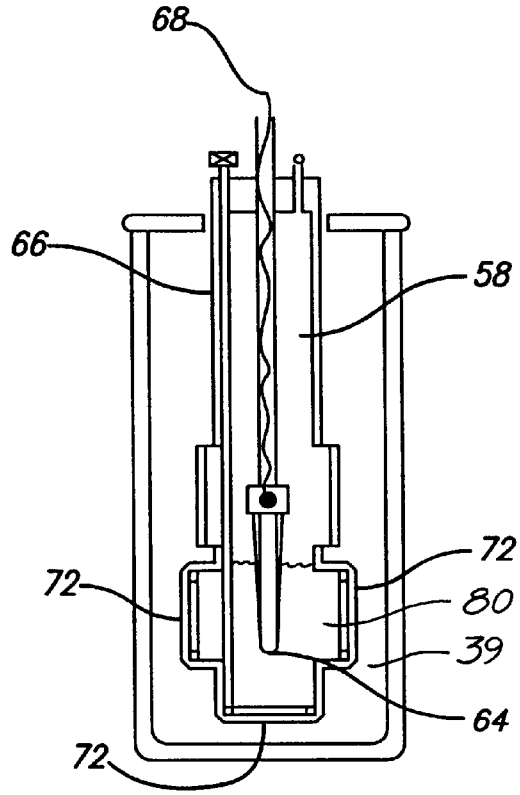
FIG. 5 is an end view of the anode chamber shown in FIG. 4.

Anode chambers 54 are fixed at intervals to the exterior of the holding tanks 38, 44. FIGS. 4 and 5 show details of the chambers. A non-metallic brine inlet 56 connects an interior cavity 58 within each chamber to the holding tanks. An anode 64 is located in the interior cavity of each chamber. Each anode is enclosed within a non-metallic casing 66, made of, for instance, polyvinyl chloride (PVC). The anode is connected to the positive output of a voltage and current source (not shown) by an anode lead wire 68. The negative output of the voltage and current source is coupled in turn to the materials to be protected (i.e., stainless steel holding tanks and conveyors, pumps, heat exchangers, and piping).

The anode 64 is preferably a platinum or mixed metal oxide anode on a substrate (with, for instance, 100 microinches of platinum or an equivalent material deposited or coated thereon); such materials are appropriate anodes when they are supported on a substrate of titanium, tantalum, or niobium because they are relatively inert (i.e., they corrode very slowly when at a positive potential and while impressing protective current). Alternatively, the anodes may be made from materials such as a high silicon cast iron molybdenum alloy which may corrode slowly and need to be periodically replaced.

An ion exchange membrane 72 acts as a barrier between the anode chamber 66 and the brine 39 that enters via the inlet 56 (see FIG. 4). This membrane separates the brine from contacting the anode 64 thereby eliminating the production of chlorine gas $Cl_2$ (and thus, the production of hydrochloric acid). The embodiment shown in FIG. 5 includes three membranes at the bottom and sides of the PVC chamber, although a single larger membrane with equivalent surface area may be used.

The anode chamber 66 contains an anolyte 80 comprised of 20% to 40% KOH by weight. Ports and tubing are provided to vent oxygen created within the chamber and to drain the anolyte or to refill or replenish the anolyte before depletion of cations and/or water decrease the effectiveness of the membrane 72. The membranes in the anode chamber 66 enclose the anode 64 immersed in the anolyte thereby preventing brine 39 from entering the anode chamber.

A bionic potential is formed across the membrane 72 by virtue of its separating two different types and/or concentrations of solutions (the anolyte 80 and the brine 39 (electrolyte)). This applied potential drives the counter-directed transport of cations along with some water from the anolyte through the membrane. More specifically, $Ca^{2+}$ ions are driven from the brine toward the anolyte, while $K^+$ ions and water are driven in the opposite direction while the membrane acts as a conductor toward the electrolyte and cathode (resulting in the production of oxygen which can be vented). As ion transport takes place even in the absence of an external electrical potential, a positive electric potential is necessary to avoid adverse counter diffusion, electromigration, or convection mechanisms (which are dependent upon the type of membrane utilized and the level of impressed current). Without such a positive potential, the calcium chloride in the brine would cause the membrane to become fouled by a $Ca(OH)_2$ precipitate. Therefore, the performance characteristics of the ion-exchange membrane selected for each application depends on the hydrophillic nature of the membrane, fixed charges available to the ions in the membranes, and the mobile counter ions balancing the typically high level of fixed charge concentration in the membrane.

If the brine 39 were to directly contact the anode 64, molecular chlorine would be produced in brine to initially produce hydrochlorous acid and chloride ions $Cl_2+H_2O=>HOCl+H^++Cl$; thus, free chlorine would need to be safely and continually removed and stored within a pressurized holding tank. Conversely, if the membrane 72 utilized is more permeable to the passage of the mobile counter ions or cations, such as potassium or sodium ions driven toward the cathode, only small levels of environmentally friendly $O_2$ gas will be vented from the anolyte chamber into the working space.

A preferred membrane 72 is a cation-exchange membrane that is very stable when exposed to both strong caustic and strong brine solutions, e.g., membrane materials that contain strong acid functionality in a perfluorinated matrix. Suitable membrane materials are produced by the E. I. DuPont De Nemours & Co. (DuPont) under the trademark Nafion (N 450 and N 324). Similar base stability products are produced by Asahi Glass and Dow. In such membranes, the fixed charge comes from sulfonic acid groups attached to pendant chains of the base-polymer backbone. These sulfonic acid groups form hydrated interconnected clusters that provide channels through the membrane. Dissociation of the sulfonic acid groups provides the fixed, negative charge sites that can be exchanged with a variety of cations. It should be appreciated that other materials, including porous glass, or plastic, or polymer diaphragms, or ceramic diaphragms, may be used as they also selectively transport ions.

The voltage and current source (not shown) impresses current at the protected metal, shifting its surface potential significantly more negative than the corrosion potential of the metal. In addition, the DC voltage applied at the anodes 64 in the anode chambers 66 must be sufficiently large to overcome the back emf positive voltage of the more noble anode surfaces, as compared to the cathodically polarized potential maintained at the negative and protected surface of metal (i.e., stainless steel), including the back emf produced by the polarized bound hydroxide protective film. Moreover, the comparatively high DC resistance of the membrane 72 must be overcome. Therefore, the potential measured across the DC output of the voltage and current source usually varies from the electricity safety limitation of six to fifteen volts in the preferred embodiment. Larger membrane surfaces may be employed to reduce the current-applied potential driving the maintenance current, and to assure ample current remains available to compensate for increasing conductivity and corrosive properties of the brine with increasing pressure and temperature (i.e.,higher voltages are needed when the brine and stainless steel are very cold, and more current is needed when the brine is warmed), and/or changes in the pH value of the brine.

Referring again to FIG. 3, the first and second holding tanks 38 and 44 also include reference electrodes 84 and 88. These reference electrodes are coupled to a controller for the voltage and current source (not shown), which is used to monitor the cathodically polarized target potential; the controller senses the relative potential difference between the reference electrodes and the protected surface of the holding tanks and operates by adjusting the impressed current to maintain a desired set potential between their surfaces. Preferably, the potential difference is set such that the protected steel surfaces remain up to about a volt more negative than the potential measured with respect to the applicable reference electrodes in the otherwise corrosive brine electrolyte 39. The potential difference may be automatically adjusted to compensate for the particular operating parameters and preserve the surfaces being cathodically protected.

Various reliable reference electrodes may be used that remain accurate in the brine 39 employed in the preferred embodiment. For example, in calcium chloride brine application at −35° F., constant ion exchange Ag/AgCl reference electrodes 84, or high purity zinc (99.99%) reference electrodes 88 may be employed.

The preferred embodiment has effectively prevented corrosion while also limiting hydrogen sulphide odors previously attributed to microbiologically influenced corrosion. In addition, while it was conventionally understood, that aside from holding tanks 38 and 44, that protective current could not be impressed to penetrate more than a few diameter lengths into piping 52 or the heat exchanger 48, the separated voltage and current source has allowed protective current to be impressed through one hundred up to five hundred equivalent pipe diameters (one pipe diameter= penetration of one inch in a one inch diameter pipe) in piping and heat exchangers.

The preferred embodiment described herein is but one example of how the invention may be used inside metal containers and structures. Modifications may be made to that embodiment and the invention may also be used in other applications, including external surfaces of metal containments and structures without in any way departing from the principles of the invention. Accordingly, the scope of the invention should be determined only with reference to the appended claims, along with the full scope of equivalent applications to which those claims are legally entitled.

What is claimed is:

1. A system for impressing current for cathodic protection of a metallic structure comprising:

a DC voltage and current source configured to impress current at the metallic structure;

an anode electrically coupled to said voltage and current source;

an anode chamber containing said anode;

an anolyte contained within said anode chamber, and in electrical contact with said anode by immersion in said anolyte;

an electrolyte in electrical contact with the metallic structure; and an ion-exchange membrane separating and allowing ionic communication between said anolyte and said electrolyte.

2. The system of claim 1 wherein said membrane is a perfluourosulfonic acid membrane.

3. The system of claim 1 wherein said anolyte includes potassium hydroxide.

4. The system of claim 3 wherein the concentration of said postassium hydroxide is approximately 20% to 40% by weight.

5. The system of claim 1 wherein said electrolyte is brine or salt water.

6. The system of claim 5 wherein said electrolyte includes calcium chloride.

7. The system of claim 6 wherein the concentration of said calcium chloride is approximately 30% by weight.

8. The system of claim 5 wherein said brine further comprises a mixture of sodium hydroxide and potassium hydroxide.

9. The system of claim 8 wherein said mixture is approximately 20% by weight sodium hydroxide, and approximately 30% by weight potassium hydroxide.

10. The system of claim 9 wherein said sodium hydroxide and potassium hydroxide are mixed in a 4:1 ratio.

11. The system of claim 1 further comprising:

at least one reference electrode coupled to the metallic structure, and a controller coupled to said reference electrode and the metallic structure and to said voltage and current source that senses the potential difference between said reference electrode and the metallic structure and maintains the potential difference at a predetermined level by adjusting the output of said voltage and current source.

12. A cathodic protection system comprising an anode connected to the positive terminal of a voltage and current source and a structure, in contact with a liquid solution, to be cathodically protected connected to the negative terminal of the voltage and current source, wherein the improvement comprises an ion exchange membrane configured to physically separate the anode from the liquid solution contained in the cathodically protected structure.

13. A system for impressing current for cathodic protection of a metallic structure used for the cooling and/or freezing of food products comprising:

a DC voltage and current source;

an anode electrically coupled to said voltage and current source;

an anode chamber containing said anode;

an anolyte contained within said anode chamber, and in electrical contact with said anode by immersion in said anolyte;

an electrolyte in electrical contact with the metallic structure; and an ion-exchange membrane separating and allowing ionic communication between said anolyte and said electrolyte.

14. The system of claim 13 wherein said membrane is a perfluorosulfonic acid membrane.

15. The system of claim 13 wherein said anolyte includes potassium hydroxide.

16. The system of claim 15 wherein the concentration of said potassium hydroxide is approximately 20% to 40% by weight.

17. The system of claim 13 wherein said electrolyte is brine or salt water.

18. The system of claim 17 wherein said electrolyte includes calcium chloride.

19. The system of claim 18 wherein the concentration of said calcium chloride is approximately 30% by weight.

20. The system of claim 17 wherein said brine further comprises a mixture of sodium hydroxide and potassium hydroxide.

21. The system of claim 20 wherein said mixture is approximately 30% by weight sodium hydroxide, and approximately 30% by weight potassium hydroxide.

22. The system of claim 21 wherein said sodium hydroxide and potassium hydroxide are mixed in a 4:1 ratio.

23. The system of claim 13 further comprising:

at least one reference electrode coupled to the metallic structure, and a controller coupled to said reference electrode and the metallic structure and to said voltage and current source that senses the potential difference between said reference electrode and the metallic structure and maintains the potential difference at a predetermined level by adjusting the output of said voltage and current source.

24. The system of claim 13 wherein the food products include a fowl product.

25. A cathodic protection system comprising:

a voltage and current source with a positive terminal and a negative terminal;

a metal holding tank electrically coupled to the negative terminal of said voltage and current source;

a liquid solution within said holding tank;

an anode coupled to the positive terminal of said voltage and current source;

an anode chamber enclosing said anode;

an electrically conductive anolyte contained within said anode chamber, said anode being immersed in said anolyte and in electrical contact with said anode; and a membrane providing a barrier with selective ionic communication between said liquid solution and said anolyte.

26. A cathodic protection system used in cooling and/or freezing food products comprising:

a voltage and current source with a positive terminal and a negative terminal;

a metal holding tank electrically coupled to the negative terminal of said voltage and current source;

a cooled liquid solution within said holding tank of the said metal holding tank for cooling the food products;

an anode coupled to the positive terminal of said voltage and current source;

an anode chamber enclosing said anode;

an anolyte contained within said anode chamber and immersed in said anolyte in electrical contact with said anode; and a membrane providing a barrier with selective ionic communication between said liquid solution and said anolyte.

27. The system of claim 26 wherein the food products include a fowl product.

28. A cathodic protection system comprising:

an anode connected to the positive terminal of a voltage and current source and a structure, in contact with a liquid solution, to be cathodically protected for use in the chilling and/or freezing of food products connected to the negative terminal of the voltage and current source, wherein the improvement comprises an ion exchange membrane configured to physically separate the anode from the liquid solution contained in the cathodically protected structure.

29. The system of claim 28 wherein the food products include a fowl product.

30. A self-adjusting system used in metal containments for cooling and/or freezing food products comprising:

a voltage and current source with a positive terminal and a negative terminal;

a metal holding tank structure electrically coupled to the negative terminal of said voltage and current source;

a cooled liquid solution within said holding tank for cooling the food products;

an anode coupled to the positive terminal of said voltage and current source;

an anode chamber enclosing said anode;

an anolyte contained within said anode chamber and immersed in said anolyte in electrical contact with said anode;

an ion-exchange membrane separating and allowing ionic communication between said liquid solution and said anolyte;

at least one reference electrode;

sensing electronics coupled to said reference electrode and said holding tank configured to determine whether the potential of a protected surface of said metal holding tank relative to said reference electrode has increased or decreased relative to a predetermined level; and adjustment electronics coupled to said voltage and current source and said sensing electronics to automatically adjust the applied voltage and current when the potential of the protected surface of said holding tank increases or decreases relative to the predetermined level.

31. A process system for rapidly chilling fowl products comprising:

a holding tank having a first end and a second end;

a chilled aqueous bath circulating from the first end of said holding tank to the second end of said holding tank;

conveyance means for transporting the fowl products into and out of the said holding tank; and cathodic protection means for preventing said holding tank from corroding.

* * * * *